US012807344B2

(12) United States Patent
King et al.

(10) Patent No.: US 12,807,344 B2
(45) Date of Patent: Nov. 24, 2026

(54) AUTOMATED PAPER TUBE FILLING MACHINE FOR RESINOUS PLANT MATERIAL WITH ADAPTIVE FILL CONTROL SYSTEM

(71) Applicant: Revolution Roller LLC, Boca Raton, FL (US)

(72) Inventors: Adam King, Simi Valley, CA (US); Marc Goldman, Boca Raton, FL (US)

(73) Assignee: Optima Fast Filler, LLC, Boca Raton, FL (US)

( * ) Notice: Subject to any disclaimer, the term of this patent is extended or adjusted under 35 U.S.C. 154(b) by 0 days.

(21) Appl. No.: 19/406,347

(22) Filed: Dec. 2, 2025

(65) Prior Publication Data

US 2026/0152304 A1 Jun. 4, 2026

Related U.S. Application Data

(60) Provisional application No. 63/726,966, filed on Dec. 2, 2024.

(51) Int. Cl.

| | |
|---|---|
| ***B65B 1/12*** | (2006.01) |
| ***A24C 5/02*** | (2006.01) |
| ***B65B 57/08*** | (2006.01) |

(52) U.S. Cl.

CPC ..... *B65B 1/12* (2013.01); *B65B 57/08* (2013.01); *A24C 5/02* (2013.01); *B65B 2210/08* (2013.01)

(58) Field of Classification Search

CPC ..... B65B 1/12; B65B 57/08; B65B 2210/08

(Continued)

(56) References Cited

U.S. PATENT DOCUMENTS 2,633,133 A * 3/1953 Higgins ..... A24C 5/42 222/413
4,556,071 A * 12/1985 Hoffmann ..... A24C 5/1871 131/906

(Continued)

FOREIGN PATENT DOCUMENTS

CN 202738802 U 2/2013
WO WO-2021081621 A1 * 5/2021 ..... B65B 1/46

OTHER PUBLICATIONS

International Search and Written Opinion for corresponding International Application No. PCT/US2025/057744, dated Mar. 26, 2026.

(Continued)

*Primary Examiner* — Christopher M Afful
(74) *Attorney, Agent, or Firm* — Leech Tishman Fuscaldo & Lampl LLC

(57) ABSTRACT

An automated machine fills cylindrical and conical paper tubes with resinous plant materials. A hopper incorporates a rounded bottom terminating in a recessed cavern that facilitates gravity-assisted material flow. Agitator mechanisms operating with randomized bidirectional motion prevent bridging while directing material toward auger intakes. Polished stainless steel augers and spigots with sub-micrometer surface roughness eliminate resin accumulation. An optical sensor system detects tube presence and monitors fill progress through differential reflectance measurements. Adaptive control algorithms calculate optimal overfill percentages based on tube geometry, ensuring uniform product weight. A spring-loaded tension mechanism with adjustable preload controls packing density. The modular architecture supports multiple independent filling lanes for parallel processing. A removable collection tray with quick-release mounting captures material for reuse.

15 Claims, 8 Drawing Sheets

(58) Field of Classification Search
USPC ..... 141/256
See application file for complete search history.

(56) References Cited

U.S. PATENT DOCUMENTS

| | | | | |
|---|---|---|---|---|
| 4,572,216 | A * | 2/1986 | Josuttis | A24C 5/42 131/70 |
| 6,739,343 | B1 * | 5/2004 | Trinkies | A24C 5/42 131/66.1 |
| 9,232,818 | B1 | 1/2016 | Munawar et al. | |
| 2006/0033919 | A1 * | 2/2006 | Moshe | G01N 21/952 356/430 |
| 2007/0107738 | A1 * | 5/2007 | Barnes | A24C 5/02 131/73 |
| 2007/0193591 | A1 * | 8/2007 | Andersen | A24C 5/42 131/70 |
| 2009/0288666 | A1 * | 11/2009 | Patel | A24C 5/02 131/57 |
| 2018/0279668 | A1 * | 10/2018 | Chan | A24C 5/321 |
| 2020/0037657 | A1 * | 2/2020 | Vecchietti | A24C 5/34 |
| 2021/0015146 | A1 * | 1/2021 | Chaben | A24B 7/14 |
| 2021/0030054 | A1 * | 2/2021 | Godwin | A24C 5/02 |
| 2022/0151283 | A1 * | 5/2022 | Forecast | A24C 5/06 |
| 2024/0156148 | A1 * | 5/2024 | Wu | A24C 5/02 |

OTHER PUBLICATIONS

Milledge, "The cleanability of stainless steel used as a food contact surface: An updated short review" (Milledge [online], Dec. 2010.

* cited by examiner

AUTOMATED PAPER TUBE FILLING MACHINE FOR RESINOUS PLANT MATERIAL WITH ADAPTIVE FILL CONTROL SYSTEM

CROSS-REFERENCE TO RELATED APPLICATIONS

This application claims priority under 35 U.S.C. § 119(e) to U.S. Provisional Patent Application No. 63/726,966, filed Dec. 2, 2024, entitled "PAPER TUBE FILLER FPR RESINOUS MATERIAL," the entire contents of which are hereby incorporated by reference herein.

FIELD OF THE INVENTION

The present invention relates generally to automated machinery for filling pre-formed paper tubes with particulate materials. More specifically, the invention pertains to a high-volume, automated machine designed to fill cylindrical and conical paper tubes with resinous plant materials, such as cannabis, as well as tobacco, incorporating adaptive fill control systems and anti-clogging mechanisms.

BACKGROUND

Machines for filling paper tubes with smoking material, particularly tobacco, are well established in the art and have been widely utilized for both personal and commercial applications. These conventional machines are configured to pack a measured quantity of loose tobacco into pre-formed paper tubes, often incorporating a filter at one end, to produce a ready-to-use product resembling a traditional cigarette. Machines also exist that wrap paper around the material and a filter it added. The primary mechanisms employed for filling operations include auger systems, which utilize rotational motion to advance material into the tube, and rod packer systems, which compress material into place through linear actuation.

These conventional machines have demonstrated effectiveness for tobacco processing due to tobacco's specific material properties, namely its relatively dry, fibrous nature and minimal adhesive characteristics. The low moisture content and non-resinous composition of tobacco allow it to flow predictably through mechanical conveyance systems without significant adhesion to internal components.

However, with the expansion of the legal cannabis market and the increasing demand for pre-filled cannabis products, the limitations of existing tobacco-filling machines have become increasingly apparent. Cannabis presents unique material handling challenges that differ substantially from tobacco. Cannabis exhibits high resin content, with trichomes containing sticky compounds that readily adhere to mechanical surfaces. This resinous characteristic leads to rapid accumulation of material on augers, feed screws, and other internal components, resulting in progressive clogging that impairs functionality.

The operational consequences of using conventional tobacco-filling machines for cannabis processing are significant. The resin build-up necessitates frequent production interruptions for cleaning operations. These cleaning procedures often require partial or complete disassembly of the filling mechanism, followed by solvent cleaning and reassembly, resulting in substantial downtime that can exceed the actual production time. Such inefficiency renders these machines unsuitable for high-volume cannabis processing operations.

Furthermore, the physical properties of cannabis differ markedly from tobacco in terms of particle size distribution and cohesive behavior. Cannabis material tends to fragment into a heterogeneous mixture of fine particles and sticky agglomerates. Fine particles may escape through clearances or clog small apertures, while sticky clumps cause mechanical jams or create inconsistencies in the packing process. These characteristics result in significant variation in fill density and weight, impacting both product quality and regulatory compliance.

Another challenge relates to accommodation of different tube geometries. While cylindrical tubes present relatively uniform filling characteristics, conical tubes—which are increasingly popular in the cannabis market—exhibit varying cross-sectional areas along their length. Conventional filling machines lack the adaptive control systems necessary to maintain consistent material density throughout the varying geometry of conical tubes.

Current solutions also fail to address the ergonomic challenges of high-volume production. Operators must frequently intervene to clear jams, manually distribute material, and perform cleaning operations, leading to repetitive stress injuries and reduced productivity. The lack of automation in material handling and jam prevention increases labor costs and limits production scalability.

Accordingly, there exists a clear and unmet need in the art for a machine specifically configured to accommodate the unique properties of cannabis and other resinous materials. Such a machine must enable efficient, consistent, and high-volume production without the frequent maintenance interruptions that plague current solutions. The machine should incorporate features that actively prevent resin accumulation, provide adaptive fill control for various tube geometries, and minimize operator intervention through intelligent automation.

BRIEF SUMMARY OF THE INVENTION

The present invention provides an automated paper tube filling machine that addresses the unique challenges associated with filling cylindrical and conical paper tubes with resinous plant materials, such as cannabis, while maintaining compatibility with traditional tobacco products. The machine incorporates multiple subsystems that work synergistically to achieve consistent, high-volume production with minimal operator intervention and maintenance requirements.

In accordance with one aspect of the invention, a machine for filling paper tubes includes a material handling system featuring a hopper with a specialized geometry including a rounded bottom section terminating in a recessed cavern. The recessed cavern is dimensioned and configured to facilitate gravity-assisted material flow while maintaining a consistent material column above an auger mechanism. At least one agitator element is positioned within the hopper and configured to execute controlled movement patterns that direct material toward the recessed cavern in a rhythmic and randomized manner, thereby preventing bridge formation and ensuring continuous material flow.

The machine incorporates an auger conveyance system wherein an auger screw is positioned within the recessed cavern and extends through a tubular spigot. The auger is mechanically coupled to a motor assembly via a protected shaft arrangement and configured to convey material from the recessed cavern through the spigot interior and into a paper tube positioned over the spigot exterior. The auger and spigot components are fabricated from highly polished stainless steel with surface roughness values below 0.8 micrometers Ra to minimize friction and prevent material adhesion.

A sensing and control system is integrated into the machine, comprising optical sensors positioned proximate to each spigot and configured to detect tube presence, alignment, and fill level through differential light reflectance measurements. The control system implements an adaptive overfill algorithm that calculates optimal fill parameters based on tube geometry, material characteristics, and historical fill data, applying calculated overfill percentages to ensure consistent product weight despite material settling.

The machine further includes a tensioning mechanism featuring spring-loaded tensioner assemblies positioned beneath each spigot. These assemblies incorporate contoured friction cups with Teflon-coated anodized surfaces that engage the tube exterior to provide controlled resistance during filling. The spring preload is adjustable via threaded adjustment mechanisms, enabling precise control over material packing density to accommodate various material types and desired product characteristics.

The machine employs a modular architecture with multiple independent filling lanes, each equipped with dedicated motor drives, auger assemblies, agitator mechanisms, sensors, and control electronics. The modular configuration provides parallel processing of multiple tubes simultaneously while maintaining independent control over each lane's operational parameters. A typical configuration comprises seven modules with two lanes each, providing fourteen simultaneous filling stations.

The agitator system represents a critical innovation, featuring fan-like elements that operate with alternating rotational directions at randomized intervals between 3 and 4 seconds. This randomized bidirectional motion prevents the formation of preferential flow channels, eliminates dead zones within the hopper, and ensures uniform material distribution to all auger inlets. The agitators are synchronized to prevent mechanical interference while maintaining optimal material flow characteristics.

An intelligent control system governs machine operation, incorporating programmable logic controllers (PLCs) or microprocessor-based controls that coordinate all subsystem operations. The control system implements multiple operational modes including normal production, cleaning cycles, material changeover sequences, and diagnostic routines. Real-time monitoring of motor currents, fill times, and sensor signals provides predictive maintenance and automatic adjustment of operational parameters to maintain consistent product quality.

The machine incorporates comprehensive material recovery features, including a removable catch tray system positioned beneath the filling stations. The catch tray employs quick-release locking plungers for tool-less removal and features smooth, angled surfaces that facilitate complete material recovery. Any material that falls during tube loading, filling, or removal operations is captured and can be easily returned to the hopper, achieving near-zero material waste.

Ergonomic considerations are integral to the machine design, with padded wrist rests positioned to support operator comfort during tube loading and unloading operations. The spigot height and angle are optimized to minimize reaching and twisting motions, while LED indicators provide clear visual feedback regarding machine status and fill completion. The control interface is positioned for easy access without requiring the operator to alter their working position.

The machine achieves multiple technical advantages over prior art systems. The polished metal components and recessed cavern design eliminate clogging issues even when processing highly resinous materials. The adaptive overfill system ensures weight consistency across production runs, critical for regulatory compliance and product quality. The modular multi-lane architecture enables production rates exceeding 1000 filled tubes per hour with a single operator. Automated material handling significantly reduces labor requirements, while the self-cleaning features significantly extend operational periods between maintenance intervals.

BRIEF DESCRIPTION OF THE DRAWINGS

A more complete understanding of the present invention, and the attendant advantages and features thereof, will be more readily understood by reference to the following detailed description when considered in conjunction with the accompanying drawings, wherein like reference numerals designate like parts throughout the figures thereof and wherein.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein.

Figure 1:
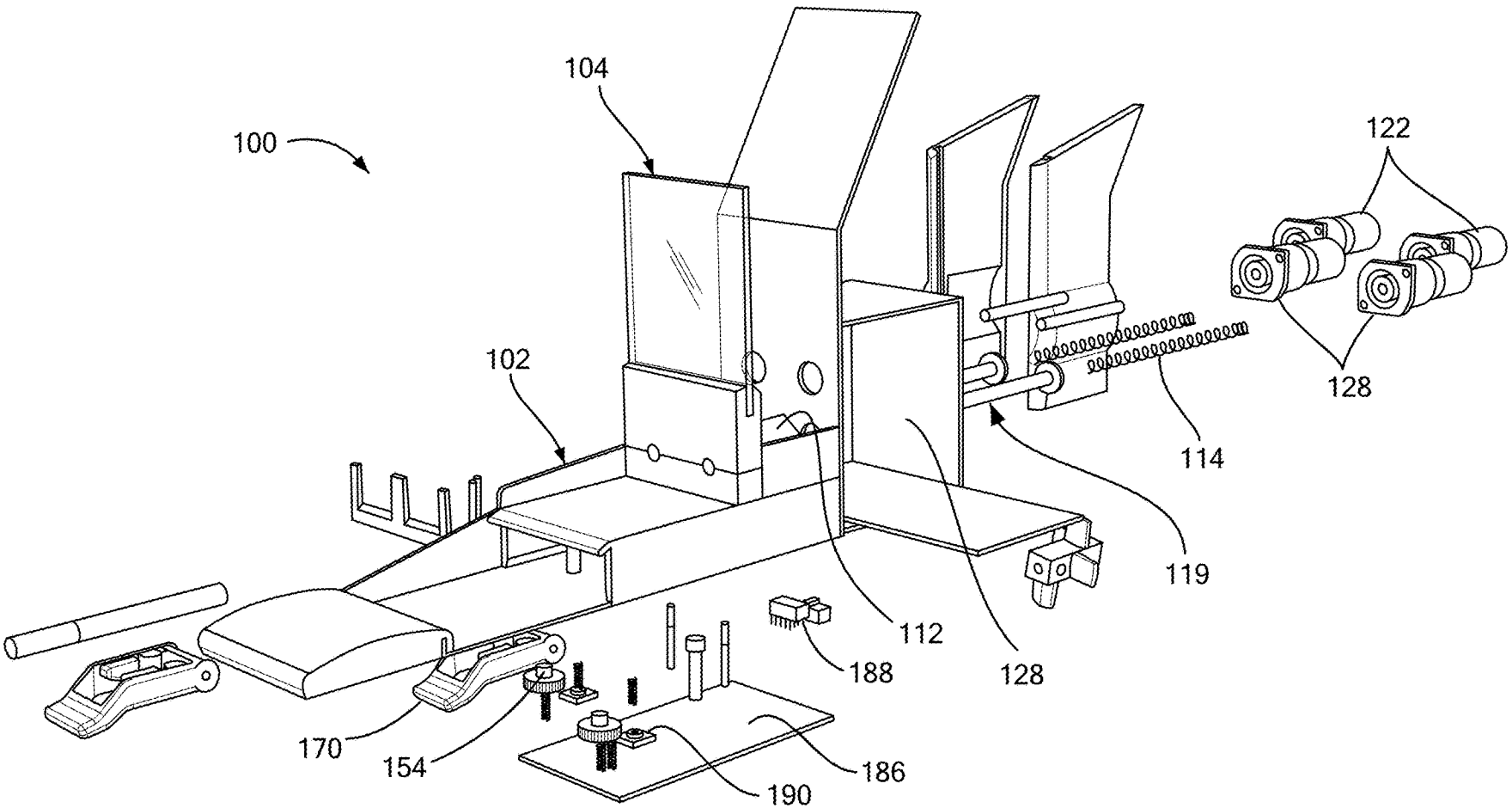
FIG. 1 is an exploded perspective view of an automated paper tube filling machine in accordance with the present invention.

Referring now to FIG. 1, an exploded perspective view illustrates the automated paper tube filling machine 100 according to the present invention. The machine 100 comprises a rigid support frame 102 that provides structural support for all operational subsystems. The frame 102 is preferably constructed from welded aluminum or steel tubing with powder-coated finish for corrosion resistance and ease of cleaning.

A material hopper assembly 104 is mounted to the upper portion of the frame 102 and configured to store bulk plant material for processing. The hopper 104 features a capacity of approximately one pound (454 grams) of material, though alternative embodiments may incorporate larger or smaller capacities depending on production requirements. The hopper 104 incorporates a specialized internal geometry described in detail below that facilitates consistent material flow without bridging or rat-holing phenomena common in conventional hoppers.

Figure 3:
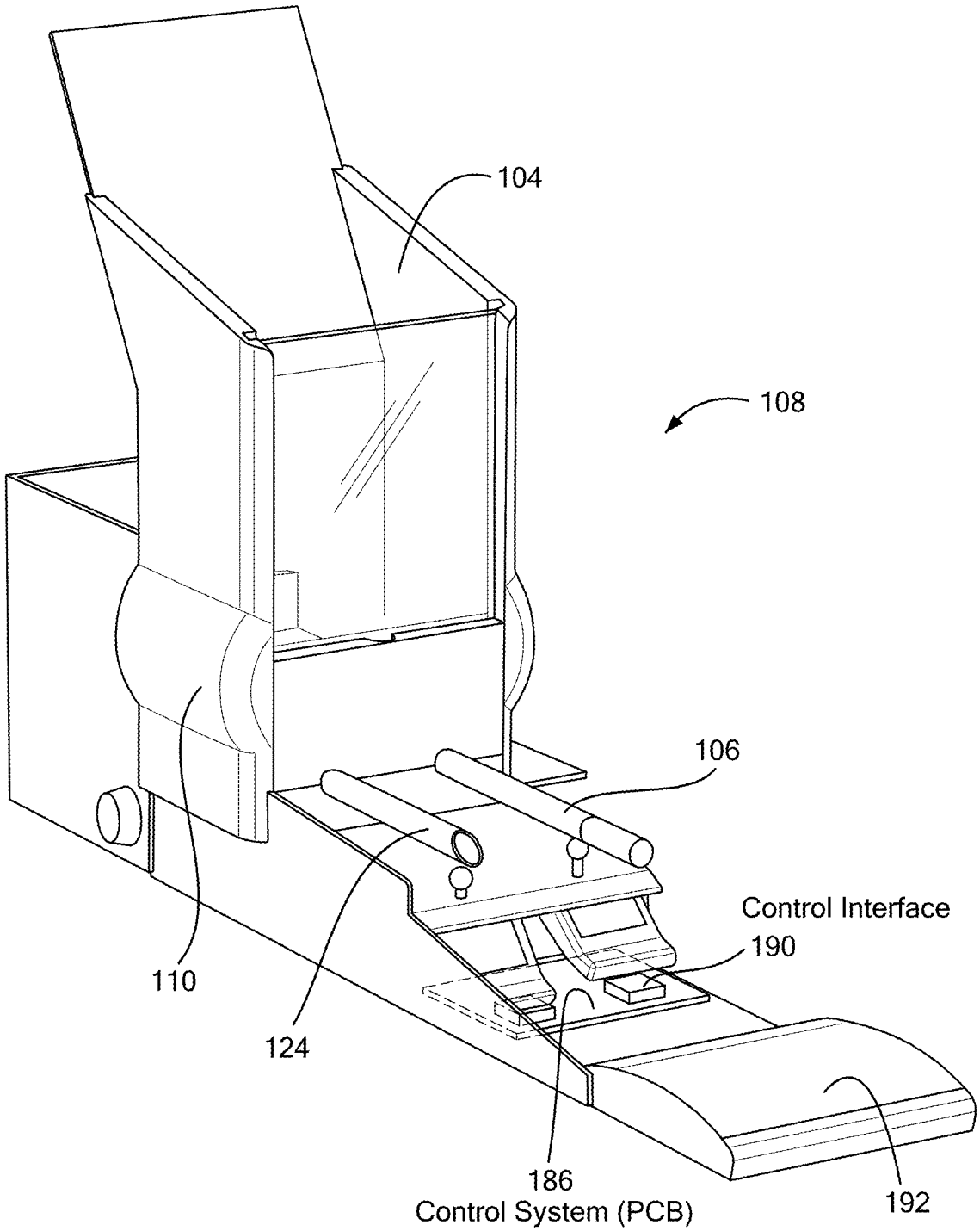
FIG. 3 is a perspective view illustrating the machine of FIG. 1 in a fully assembled operational configuration.

Multiple filling lane assemblies 106 are arranged in parallel configuration beneath the hopper 104. In the illustrated embodiment, fourteen lanes are provided, organized as seven modular units 108 (see FIG. 3) each containing two lanes. Each lane assembly 106 operates independently, enabling continued production even if individual lanes require maintenance or adjustment. This modular architecture also facilitates machine customization, as modules can be added or removed to match production capacity requirements. Of course the lanes can be provided in a fixed number as well rather than as removable modules.

Figure 2:
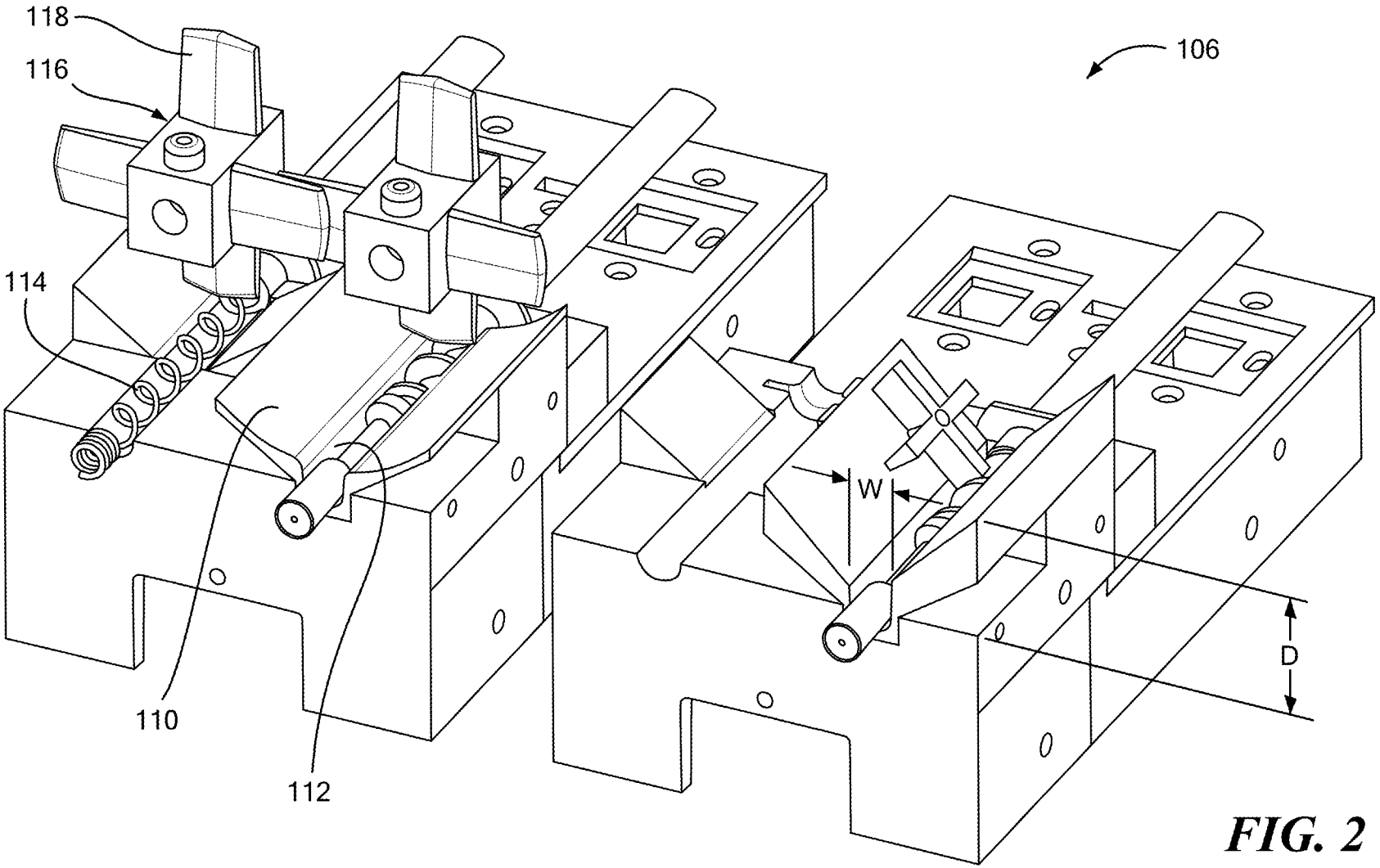
FIG. 2 is a perspective view depicting a material hopper, showing an auger mechanism positioned within the recessed cavern, agitator elements, and a spigot assembly with associated sensor placements.
Figure 2A:
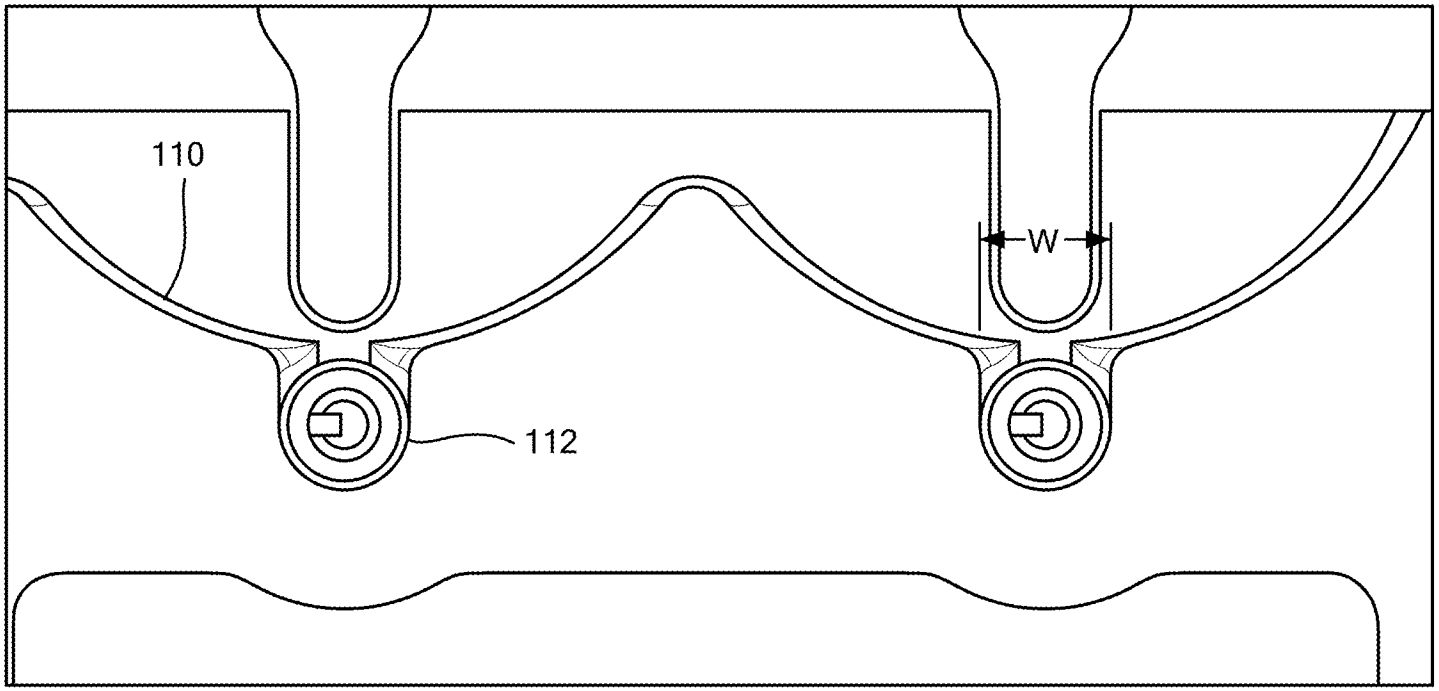
FIG. 2A is a sectional view of an embodiment of the material hopper.

Referring to FIGS. 2 and 2A, the hopper 104 features a rounded bottom section 110 that transitions smoothly into a recessed tray or cavern 112. This geometry eliminates sharp corners where material might accumulate and creates a natural funneling effect that directs material toward the auger intake regions.

The recessed cavern 112 is specifically dimensioned to maintain a column of material above an auger screw 114 while preventing excessive compression that might impede material flow. The cavern depth D is preferably between 25 and 50 millimeters, with the optimal dimension determined by the specific material characteristics and auger diameter. The cavern width W is approximately 1.2 to 1.5 times the auger outer diameter, providing adequate material reservoir capacity while maintaining uninterrupted flow and flow consistency.

At least one agitator mechanism 116, and preferably multiple agitators, are positioned within the hopper interior. Each agitator 116 comprises paddle-like or fan-shaped elements 118 mounted on a shaft 119 driven by an agitator motor 122. The agitators 116 execute controlled rotation patterns that actively move material toward the recessed cavern 112 while preventing the formation of stable bridges or arches that could interrupt material flow.

An agitator control system implements a motion profile wherein the rotational direction reverses at randomized intervals between 3 and 4 seconds. For example, the agitator might rotate clockwise for 3.7 seconds, pause briefly, then rotate counterclockwise for 3.2 seconds. This randomization prevents the establishment of preferential flow patterns and ensures uniform material distribution across all feeding points. The randomization algorithm preferably employs a pseudo-random number generator with uniform distribution to determine interval durations.

Adjacent agitators 116 are synchronized to prevent mechanical interference while maintaining complementary flow patterns. In one embodiment, adjacent agitators rotate in opposite directions during any given interval, creating a coordinated material movement pattern that efficiently directs material toward multiple auger intake points simultaneously.

Figure 5:
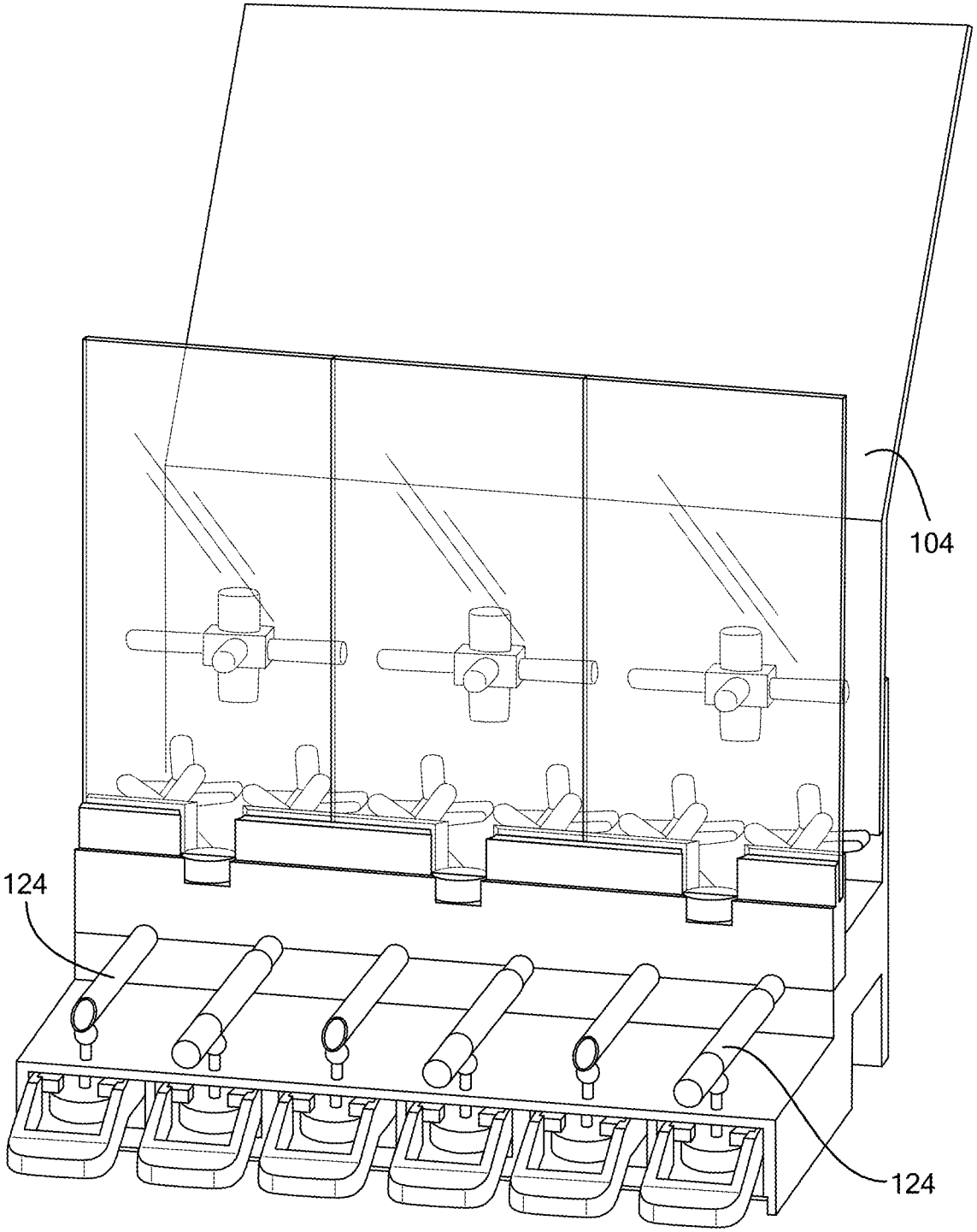
FIG. 5 is a perspective view illustrating lane configuration with the hopper assembly rendered transparent to reveal the internal agitator mechanisms.

The auger screw 114 is positioned within the recessed cavern 112 with its axis oriented substantially horizontally, though slight inclination angles up to 15 degrees may be employed to optimize material flow characteristics. The auger 114 extends through a tubular spigot 124 (see FIGS. 5 and 6) that projects from the hopper assembly 104. The spigot 124 serves as both a material conveyance channel and a mounting interface for paper tubes during filling operations.

The auger screw 114 is precision-machined from stainless steel, preferably 316L grade for optimal corrosion resistance and surface characteristics. The screw features a constant pitch design with pitch-to-diameter ratio between 0.8 and 1.2, optimized for consistent material conveyance without excessive compression. The auger flight edges are radiused to prevent material shearing and reduce particle size degradation during conveyance.

Both the auger 114 and spigot interior surface receive specialized surface treatment to achieve ultra-low surface roughness. The surfaces are progressively polished through multiple stages, ultimately achieving surface roughness values below 0.8 micrometers Ra, and preferably below 0.4 micrometers Ra. This mirror-like finish prevents resin adhesion and facilitates self-cleaning action as material moves through the system.

The auger 114 connects to a drive motor 128 via a protective shaft assembly that incorporates a plastic or polymer sleeve (not shown) that prevents material ingress into the mechanical drive components. The sleeve also provides a wear surface that can be easily replaced without affecting the more expensive drive components. The sleeve can be fabricated from ultra-high molecular weight polyethylene (UHMWPE) or similar low-friction polymer material.

A quick-release coupling mechanism (not shown) enables rapid auger removal for cleaning or replacement. The coupling can employ a quarter-turn bayonet mount or similar tool-free engagement system, allowing auger changes in less than 30 seconds. This feature is particularly advantageous when switching between different material types that may require different auger configurations.

Figure 6:
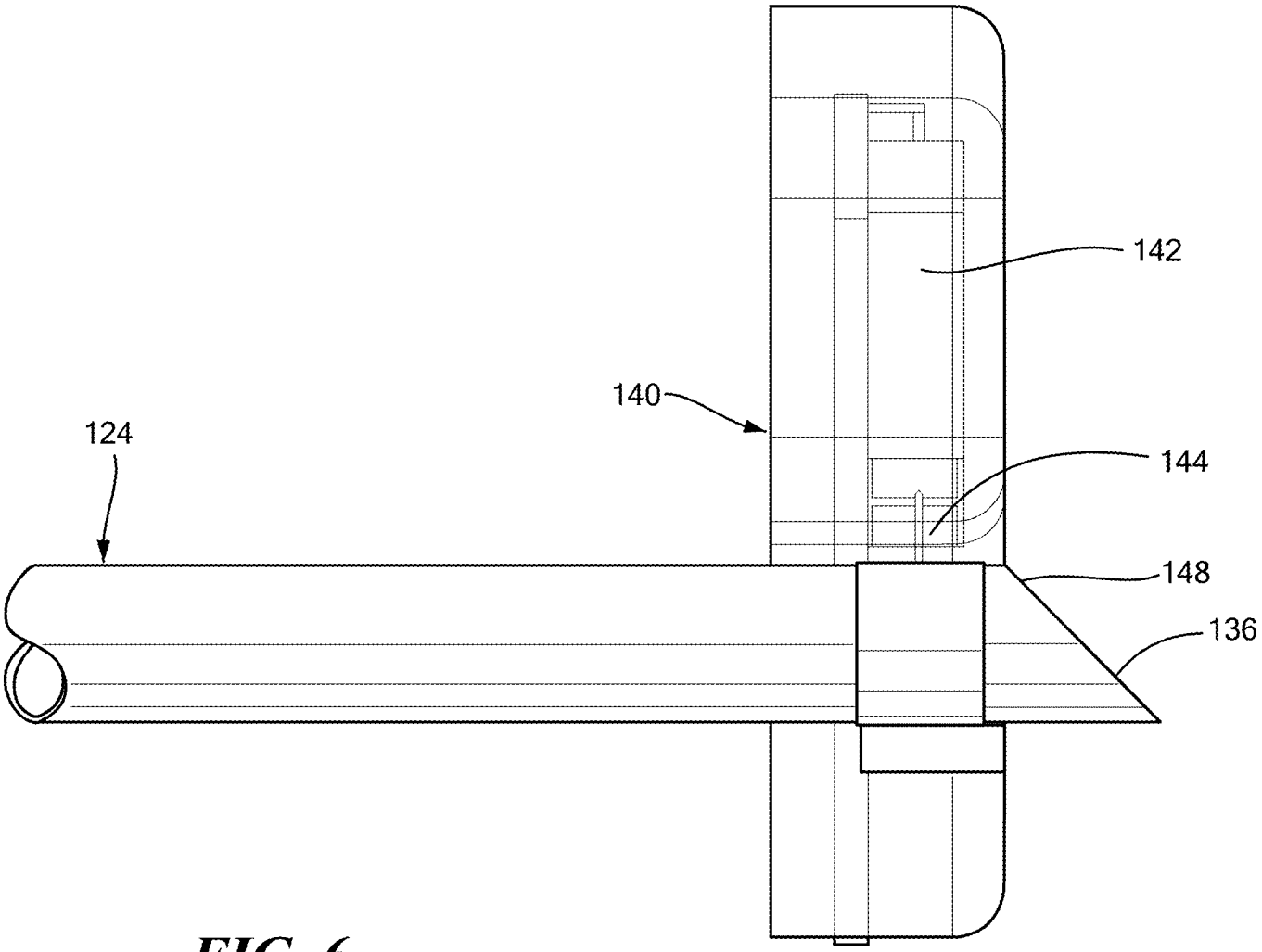
FIG. 6 is a detailed side view of a sensor mechanism for preventing overfill.

As shown in FIG. 6, the spigot 124 incorporates several features that facilitate tube loading and optimal filling performance. A spigot outlet 136 features a 45-degree chamfer that guides tubes during placement and prevents edge catching that could damage the tube or impede proper seating. The spigot outer diameter is precisely controlled to provide adequate clearance for tube placement while maintaining sufficient engagement for stable tube retention during filling.

Figure 7:
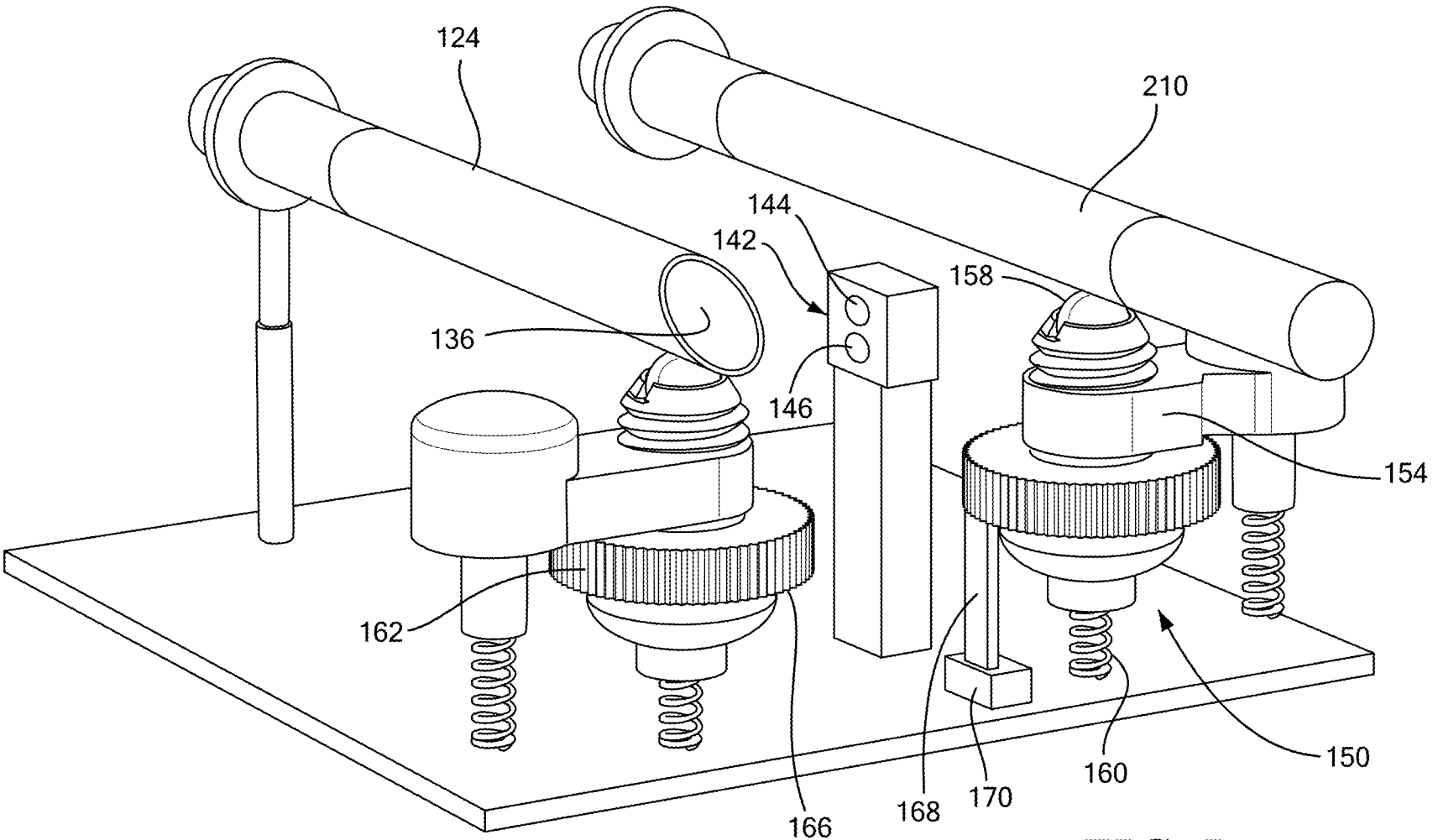
FIG. 7 is a perspective view of tension control and fill density adjustment mechanisms.

Referring to FIGS. 6 and 7, the machine incorporates optical sensing systems 140 for detecting tube presence, alignment, and fill status. Each spigot assembly includes an optical sensor module 142 positioned to monitor the spigot region where tubes are placed. The sensor module 142 comprises an infrared LED emitter 144 and photodetector 146 arranged in a reflective configuration.

The spigot surface 148 proximate to the sensor can be polished chrome or provided with a coating having controlled optical properties that are detectable in the sensor's operational wavelength range. When no tube is present, the sensor detects a first value of reflected light from the spigot surface. When a paper tube is positioned over the spigot, the higher reflectance of the paper material (typically 40-60% for white paper) creates a substantial change in the detected signal level. The sensor system continuously monitors the reflected light intensity and compares it against calibrated threshold values stored in the control system memory. The thresholds are adaptively adjusted based on ambient conditions and can accommodate variations in tube color, thickness, and surface texture. A sophisticated signal processing algorithm filters out noise and transient reflections to prevent false triggering. Beyond simple presence detection, the sensor system monitors the tube position during filling operations. As material fills the tube, it gradually pushes the tube off the spigot. The sensor detects this movement through changes in the reflected light pattern. When the tube reaches a predetermined fill position, corresponding to the desired fill level, the sensor triggers the control system to stop the auger and agitator motors.

The control system implements an adaptive overfill algorithm particularly important for conical tubes. The algorithm calculates the theoretical fill time based on tube geometry, material flow rate, and desired fill weight. It then applies a calculated overfill percentage, typically 5-15%, to compensate for material settling and ensure consistent final product weight. The overfill percentage is dynamically adjusted based on feedback from quality control measurements, creating a closed-loop control system that maintains tight weight tolerances. For both cylindrical and conical tubes, the control system maintains a database of tube profiles with associated fill parameters. When a specific tube type is selected via the operator interface, the system automatically loads the corresponding parameters and adjusts the fill algorithm accordingly. This eliminates the need for manual adjustment when switching between different tube styles.

Referring again to FIG. 7, a tension control mechanism 150 provides precise control over material packing density within the tubes. Each filling lane incorporates an independent tension control mechanism positioned beneath the corresponding spigot 124. The mechanism 150 includes a spring-loaded tensioner cup 154 that engages the lower portion of the tube during filling operations.

The tensioner cup 154 features a carefully engineered internal profile that conforms to the tube geometry. For cylindrical tubes, the profile comprises a constant-radius cylindrical surface. For conical tubes, the profile may incorporate a tapered geometry or flexible elements that adapt to the varying tube diameter. The contact surface 158 of the cup 154 receives a multi-layer surface treatment comprising hard anodization followed by Teflon (PTFE) coating application. This treatment provides low friction, prevents material adhesion, and ensures consistent engagement forces throughout extended production runs. A compression spring 160 applies upward force to the tensioner cup 154, creating resistance as material fills the tube and pushes it downward. The spring rate is selected to provide appropriate resistance without crushing or deforming the paper tube. Typical spring rates range from 0.5 to 2.0 N/mm, depending on tube characteristics and desired fill density. An adjustment mechanism 162 enables precise control over the spring preload and thus the fill density. The mechanism 162 comprises a threaded adjustment screw that varies the spring compression. Each complete rotation of the screw produces a calibrated change in spring force, enabling repeatable density adjustments. Scale markings 166 on the adjustment mechanism provide visual reference for density settings. The tension control mechanism 150 incorporates an over-center linkage mechanism 168 for smooth engagement and disengagement. As the operator actuates a trigger lever 170, the linkage 168 transitions through a mechanical dead-center position, providing positive locking in the engaged position while requiring minimal holding force. This reduces operator fatigue during extended production periods. A self-centering feature ensures proper alignment between the tensioner cup 154 and the tube axis. The cup mounting incorporates a gimbal or floating suspension that allows limited angular adjustment. This accommodation for misalignment prevents side loading that could damage tubes or cause inconsistent filling.

Figure 4:
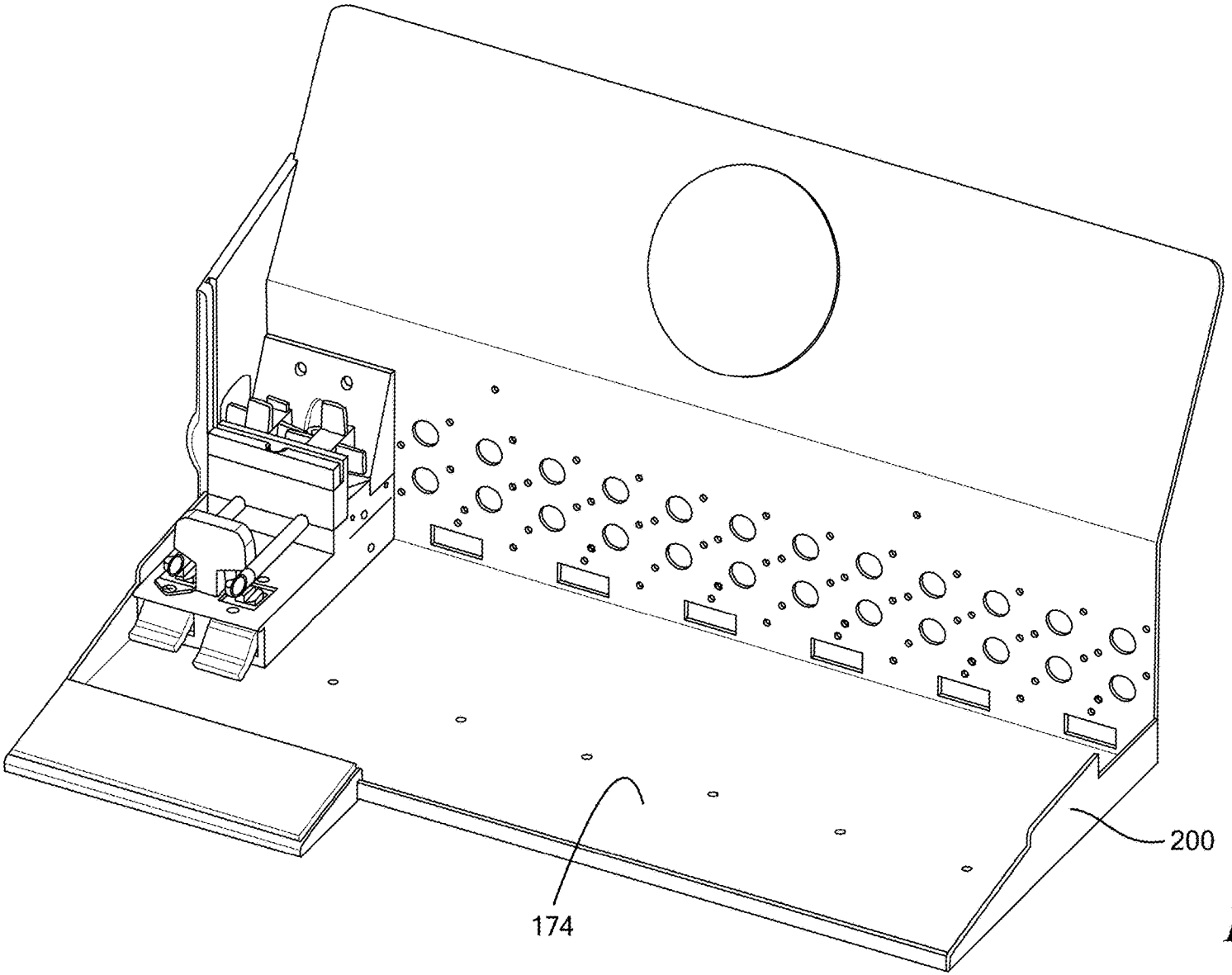
FIG. 4 is a perspective view showing a frame for a modular lane arrangement with multiple parallel filling stations.

The machine incorporates comprehensive material recovery features that minimize waste and maintain a clean operating environment. A collection tray 174 is positioned beneath the filling stations to capture any material that falls during operation. The tray 174, shown in FIG. 4, can feature smooth, angled surfaces that direct material toward a central collection zone. The tray 174 employs a quick-release mounting system comprising spring-loaded locking plungers. The plungers engage with corresponding receptacles in the frame structure, providing secure retention during operation while enabling tool-free removal for emptying. The operator simply depresses the plunger heads to release the tray, which can then be lifted out, emptied, and quickly reinstalled. The tray geometry facilitates complete material recovery without tools or brushes. The surfaces are coated with a non-stick material or highly polished to prevent material adhesion. Recovered material can be poured directly back into the hopper 104 or stored for later use, achieving essentially zero material waste.

A machine control system 186, shown in FIG. 1, coordinates all operational subsystems to achieve optimal performance. The control system 186 comprises a programmable logic controller (PLC) or embedded microprocessor system 188 with appropriate input/output interfaces for sensor signals and motor control. An operator interface 190 provides intuitive control over machine functions and displays real-time operational status. Control software implements multiple operational modes optimized for different production scenarios.

In a "Normal Production Mode" all systems operate according to programmed parameters with automatic tube detection, filling, and completion indication. The operator simply places empty tubes 210 and removes filled products while the machine handles all other functions autonomously. In a "Learning Mode" the system can be trained for new tube types by running sample fills while monitoring sensor responses and fill characteristics. The learned parameters are stored in non-volatile memory for future use. In a "Cleaning Mode" a specialized sequence facilitates rapid material changeover and cleaning. The augers can be reversed to evacuate residual material, and the agitators run at maximum speed to empty the hopper completely. In a "Diagnostic Mode" comprehensive self-test routines verify proper operation of all sensors, motors, and control circuits. Any detected faults are reported via the operator interface with specific troubleshooting guidance. In a "Manual Override Mode" individual subsystems can be controlled directly for maintenance, adjustment, or special operations. This mode enables functions such as manual auger reversal for jam clearing or independent agitator control for material distribution adjustment.

The control system continuously monitors operational parameters including motor currents, fill times, sensor signals, and production counts. Trend analysis algorithms detect gradual changes that might indicate developing problems, enabling predictive maintenance before failures occur. For example, gradually increasing motor current might indicate auger wear or material build-up, triggering a maintenance alert before production is affected. Data logging capabilities record production statistics, quality metrics, and maintenance events. This information can be exported via USB or network connection for analysis, regulatory compliance documentation, or integration with larger production management systems.

The machine provides operator comfort and safety throughout extended production periods. Padded wrist rests 192 (see FIG. 3) are positioned for tube manipulation, reducing strain on the wrists and forearms. The rests 192 are adjustable to accommodate operators of different heights and working preferences. LED indicator lights provide clear visual feedback for each filling lane. In an exemplary embodiment, green light indicates ready to change the tube and a tube is filled, flashing green means the machine is in operation, amber indicates filling in progress, and red indicates a filled tube ready for removal or a fault condition, or flashing red is cleaning and maintenance in progress, and solid red indicates a technical fault. High-brightness LEDs are visible even in bright ambient lighting conditions. All moving parts are enclosed within protective guards that prevent accidental contact while maintaining visibility for operation monitoring. One or more emergency stop buttons can be positioned within easy reach of normal operating positions, such as the side of the machine. Activation immediately halts all motor operation while maintaining sensor power for status monitoring. The system can be quickly restarted once the emergency condition is resolved. The machine operates below 70 dBA at the operator position, enabling comfortable operation without hearing protection.

The operation method for the automated paper tube filling machine will now be described with reference to the complete system illustrated in FIGS. 1-7. The operator begins by loading bulk plant material into the hopper 104, filling to approximately 80% capacity to maintain optimal flow characteristics. The control system 186 is powered on and the desired tube type is selected via the control interface 190. The system automatically loads the corresponding fill parameters from memory. Empty paper tubes 210 are placed onto the spigots 124, with the chamfered outlets 136 guiding proper placement. The optical sensors 140 detect tube presence. For operations using the tension control system, the operator engages the tensioner cups 154 using the trigger levers 170. The operator initiates the fill cycle via the control interface 190 or foot pedal switch. The agitator motors 122 begin their programmed rotation patterns, moving material toward the recessed caverns 112. Simultaneously, the auger motors 128 activate, conveying material through the spigots 124 and into the tubes 210. The control system 186 continuously monitors the sensor signals and motor parameters during filling. As tubes fill, they gradually move off the spigots due to the increasing weight of material. The sensors 140 track this movement and trigger motor stop when the predetermined fill position is reached. For conical tubes, the adaptive overfill algorithm applies calculated overfill percentages to ensure consistent final weight despite the varying geometry. The control system may modulate auger speed or implement pulsed operation to achieve optimal fill characteristics. When filling is complete, a light or audio signal can alert the operator. The filled tubes are removed and placed into packaging or storage containers. Any material that falls during tube handling is captured by the collection tray 174. The cycle repeats with new tube placement and automatic fill initiation. Modular lanes enable continuous production even if individual lanes are temporarily inactive. When hopper material runs low, as indicated by sensor monitoring or visual inspection, the operator adds material without stopping production. The hopper geometry and agitator operation ensure smooth integration of new material without disrupting ongoing fills. At production completion, the cleaning mode evacuates residual material from the system. The collection tray 174 is removed and emptied, with recovered material returned to storage. Quick-release mechanisms enable rapid disassembly of components requiring cleaning.

While the invention has been described with reference to preferred embodiments, various modifications and alternatives fall within the scope of the invention. For example, the number of filling lanes can be varied from a single lane for low-volume applications to 20 or more lanes for large-scale production. Optional modular architecture facilitates customization to specific production requirements. Alternative agitator configurations employ orbital motion, reciprocating linear motion, or vibratory action rather than rotational motion. The auger mechanism may be replaced or supplemented with alternative conveyance means such as vibratory feeders, belt conveyors, or pneumatic systems, provided they achieve consistent material flow without clogging. The optical sensing system may be replaced with alternative sensor technologies including capacitive sensors, ultrasonic sensors, or machine vision systems, provided they reliably detect tube presence and fill status. The tension control mechanism can employ pneumatic actuators, servo-controlled motors, or hydraulic systems rather than mechanical springs, enabling programmable force profiles during filling. The control system can incorporate artificial intelligence or machine learning algorithms that optimize fill parameters based on historical data and quality feedback, continuously improving performance over time. Additional features can include integrated weighing systems for real-time fill weight monitoring, automated tube feeding magazines for continuous operation, or robotic tube handling for fully automated production.

The present invention provides numerous advantages over conventional tube filling machines. For example, the combination of ultra-smooth polished surfaces, recessed cavern geometry, and active agitation prevents the resin accumulation that plagues conventional machines. Extended operation without cleaning is achievable even with highly resinous materials. The adaptive overfill algorithm and precision tension control ensure uniform fill weights and densities across all tubes, critical for regulatory compliance and customer satisfaction. The multi-lane parallel processing architecture and automated operation enable production rates far exceeding conventional machines while requiring fewer operators. Automation of material handling, fill control, and jam prevention reduces operator intervention compared to conventional systems. The system accommodates various tube sizes and geometries without mechanical modifications, requiring only parameter selection via the control interface. The comprehensive material recovery systems achieve near-zero material waste, which is important for expensive materials. Self-cleaning features and robust construction extend the time between required maintenance compared to conventional machines. Operator interfaces and working positions reduce fatigue and injury risk during extended production periods. The modular architecture enables production capacity to be matched to business requirements and expanded as needed without replacing the entire machine. Comprehensive data logging and communication capabilities enable integration with quality management systems and regulatory compliance documentation.

The automated paper tube filling machine of the present invention finds application in various industries requiring efficient filling of tubes with particulate materials. Primary applications include cannabis production, tobacco processing, and herbal products. The invention enables profitable operation at various production scales.

While the invention has been described in detail with reference to exemplary embodiments thereof, it will be apparent to those skilled in the art that various changes and modifications can be made therein without departing from the spirit and scope of the invention as defined by the appended claims.

The invention claimed is:

1. An automated machine for filling a paper tube with particulate plant material, comprising: a material hopper having a bottom section terminating in a recessed cavern, the recessed cavern having a depth and width dimensioned to receive plant material; an agitator mechanism positioned within the hopper and configured to move the material toward the recessed cavern; and an auger screw positioned within the recessed cavern and extending through a tubular spigot, the recessed cavern being dimensioned relative to the auger screw such that a column of the plant material is maintained above the auger screw, the auger screw mechanically coupled to a motor drive and configured to convey material from the recessed cavern through the spigot; wherein the agitator mechanism is configured to operate with alternating rotational directions at randomized intervals to prevent bridging of the plant material.

2. The machine of claim 1, wherein the bottom section of the material hopper has a rounded profile.

3. The machine of claim 1, further comprising an optical sensor system positioned proximate to the spigot and configured to detect presence and position of the paper tube through differential light reflectance measurements.

4. The machine of claim 3, further comprising a control system operatively connected to the motor drive, the agitator mechanism, and the optical sensor system, the control system implementing a fill algorithm.

5. The machine of claim 4, wherein the control system implements multiple operational modes comprising:

a normal production mode for automated filling operations;

a learning mode for characterizing new tube types;

a cleaning mode with auger reversal capability;

a diagnostic mode for system testing; and a manual override mode for direct subsystem control.

6. The machine of claim 4, wherein the control system is configured to stop the auger screw when the optical sensor system detects that the paper tube has moved to a predetermined fill position.

7. The machine of claim 3, wherein the optical sensor system comprises:

an infrared emitter;

a photodetector positioned to receive reflected light; and signal processing circuitry configured to adaptively adjust one or more detection thresholds based on a reflectance of the paper tube to accommodate paper tubes of differing color.

8. The machine of claim 1, further comprising a tension control assembly positioned beneath the spigot and configured to apply adjustable resistance to the tube during filling operations.

9. The machine of claim 8, wherein the tension control assembly comprises:

a tensioner cup having an internal profile configured to conform to tube geometry;

a compression spring applying force to the tensioner cup;

an adjustment mechanism for varying spring preload; and a surface treatment on the tensioner cup comprising anodization and PTFE coating.

10. The machine of claim 1, wherein the auger screw and an interior surface of the spigot comprise stainless steel with a surface roughness value below 0.8 micrometers Ra.

11. The machine of claim 1, wherein the agitator mechanism comprises:

paddle elements mounted on a shaft;

a motor drive configured to rotate the shaft; and a control algorithm that controls rotation direction.

12. The machine of claim 11, wherein the control algorithm reverses rotation direction at randomized intervals between 3 and 4 seconds.

13. The machine of claim 1, further comprising a plurality of independent filling lanes, each lane comprising:

a dedicated motor drive;

an independent auger screw and spigot assembly;

an associated agitator mechanism;

a separate optical sensor system; and individual tension control assembly.

14. The machine of claim 1, wherein the spigot comprises a 45-degree chamfer at an outlet end to facilitate tube placement.

15. The machine of claim 1, wherein the recessed cavern has a width between approximately 1.2 and 1.5 times an outer diameter of the auger screw and a depth between approximately 25 and 50 millimeters.

* * * * *